US005998717A

United States Patent [19]

Chen

[11] Patent Number: 5,998,717

[45] Date of Patent: Dec. 7, 1999

[54] STRUCTURAL IMPROVEMENT OF CONNECTING MECHANISM FOR KETTLEDRUM MECHANISM FOR CONNECTING A KETTLEDRUM TO A SUPPORT STAND

[76] Inventor: Chang-Wen Chen, 7 Fl., No. 34, Alley 100, Lane 109, Sec. 2, Mu-Cha Rd., Taipei, Taiwan

[21] Appl. No.: 09/114,046

[22] Filed: Jul. 13, 1998

[51] Int. Cl.[6] ..... G10G 5/00; G10D 13/02

[52] U.S. Cl. ..... 84/421; 84/104; 84/411 R

[58] Field of Search ..... 84/104, 411 A, 84/411 R, 412, 421

[56] References Cited

U.S. PATENT DOCUMENTS 4,519,289 5/1985 Gauger ..... 84/421

5,337,645 8/1994 Johnston ..... 84/421

*Primary Examiner*—Robert E. Nappi

*Assistant Examiner*—Marlon T. Fletcher

*Attorney, Agent, or Firm*—Bacon & Thomas, PLLC

[57] ABSTRACT

A kettledrum is connected to a support leg stand by a connecting mechanism which includes a connecting member attached to the leg stand and a drum clamping mechanism attached to the counterhoop of the drum. The drum clamping mechanism includes an auxiliary clamping unit having a joining part which engages a joining hole formed in a main clamping unit. Three connecting mechanisms may be equiangularly spaced around the drum for providing a stable support of the drum and reduction of vibrations.

4 Claims, 6 Drawing Sheets

STRUCTURAL IMPROVEMENT OF CONNECTING MECHANISM FOR KETTLEDRUM MECHANISM FOR CONNECTING A KETTLEDRUM TO A SUPPORT STAND

FIELD OF THE INVENTION

The invention relates to a structural improvement of connecting mechanism for a kettledrum, particularly to a connecting mechanism for the connection of a kettledrum with the support leg stand, so the support for the kettledrum can be more stable while the vibration factor on the drum shell can be reduced.

BACKGROUND OF THE INVENTION

Conventionally, a regular support for a kettledrum involves support holes on the drum shell, with three fixing units to directly tighten the support holes, and on the fixing units is fixed the support leg stand, thus to form a support surface to maintain a proper distance between the kettledrum and the floor; however, in the above support method, because of the installation part on the counterhoop, the distance and angle between the support leg stands could not be equally divided at 120° intervals, instead, they are divided at the angles of 110°, 115°, 115°, therefore, the formed support surface could not achieve a sufficient supporting effect for the kettledrum, and the drilling of support holes on the drum shell will cause sophisticated production procedures and cause a major harm to the drum itself.

Furthermore, since the support holes are located at specific positions on the drum, in case the drummer needs to change the location of the kettledrum due to the accompaniment by various musical instruments, he will have to relocate the kettledrum because of different intervals of the support leg stands, or he will have to remove the support legs to make necessary adjustment, and the placement location will not be compatible after said adjustment is made, therefore, some drummers will have to make another integrated placement of the accompanying musical instruments due to the above complicated procedures for adjustment, then he will have to make necessary selection to suit different song or music styles, but actually, the placement of too many musical instruments will reduce the battering smoothness to the drummer, so the integral quality of the drumming effect will be affected;

Besides, when the fixing unit is directly fixed on the drum, it will affect the drum resonance, the drumming sound will become dull and inactive, besides, the drum must be suspended for battering effect under some particular circumstances, but since the fixing unit is directly fixed to the drum, the drum will become too heavy to be suspended; therefore,

OBJECTIVE OF THE INVENTION

The primary objective of the present invention is to solve the above shortcomings, and avoid the existence of drawbacks, the present invention involves the connection by means of a connecting mechanism located between the support leg stand and the counterhoop of a kettledrum, so there will be a proper distance between the kettledrum and the floor, said connecting mechanism comprising a connecting unit that is connected to a support leg stand, and on said connecting unit is connected a drum clamping mechanism that is composed of a main and an auxiliary clamping units, to join the counterhoop of the kettledrum; said connecting mechanism serving to connect the kettledrum and the support leg stand, so the kettledrum will be supported more steadily while the vibration factor on the drum shell will be reduced.

DETAILED DESCRIPTION OF PREFERRED EMBODIMENT

Figure 1:
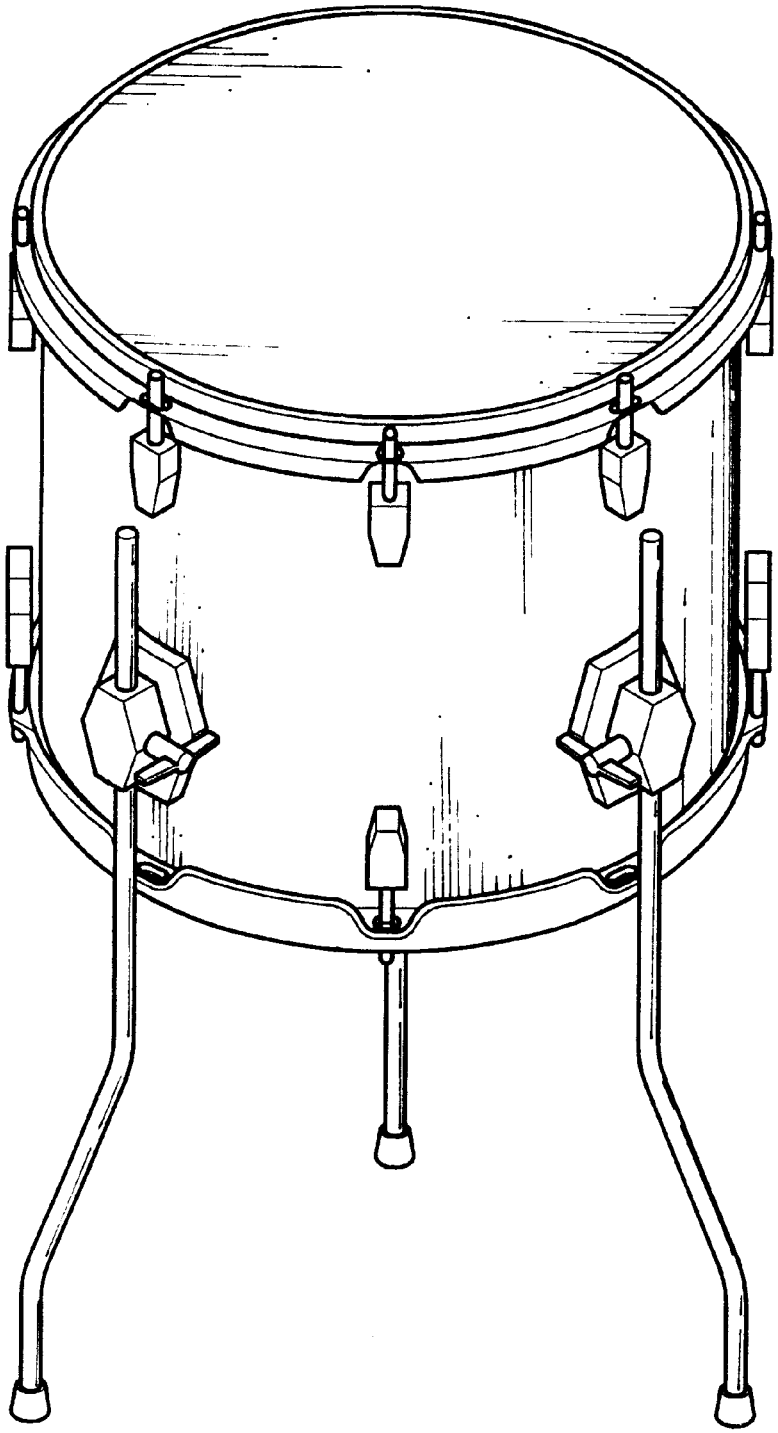
Fig. 1 PRIOR ART
FIG. 1 is a perspective view of a prior art.
Figure 2:
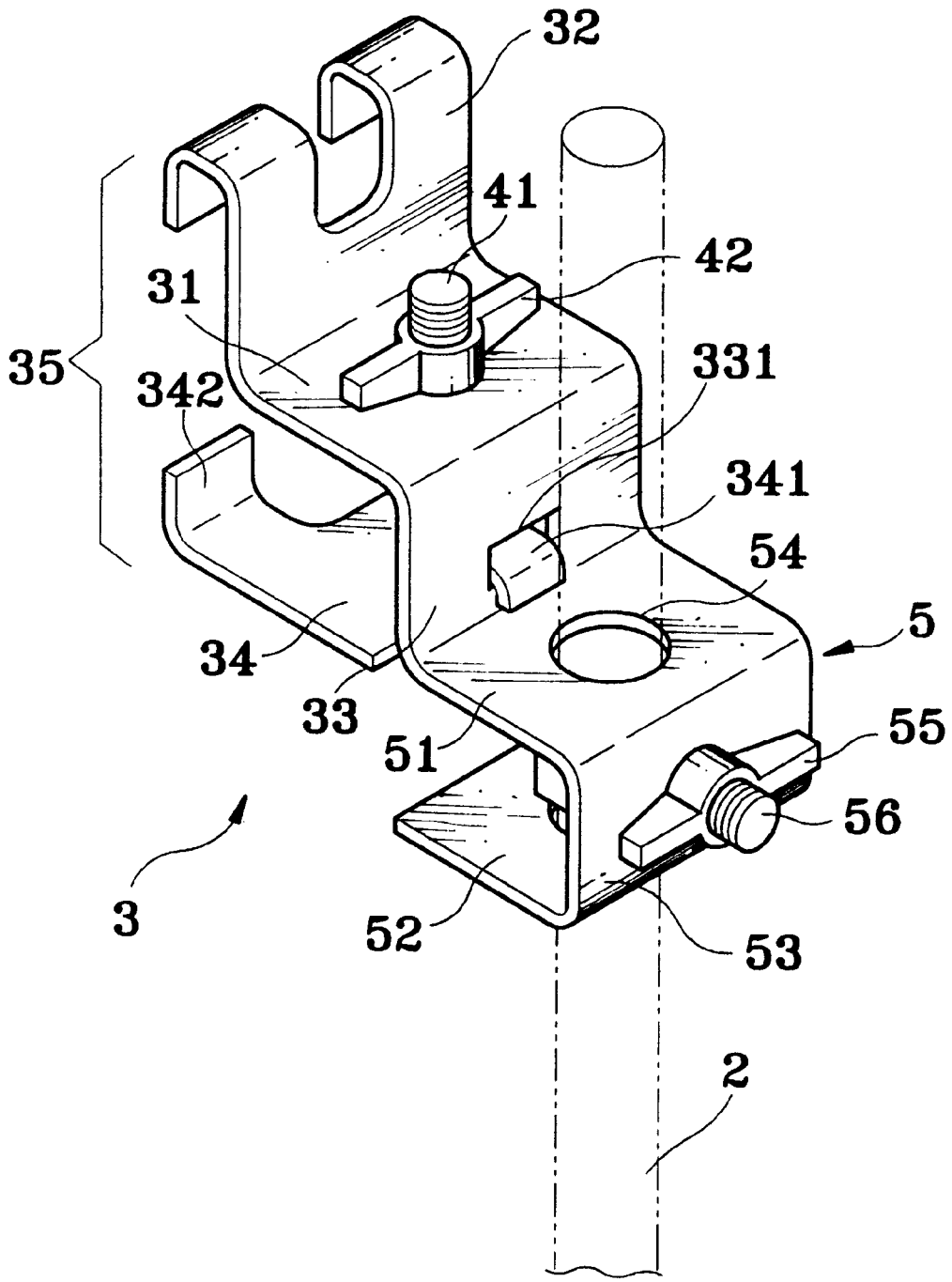
FIG. 2 is a perspective view of the present invention.
Figure 3:
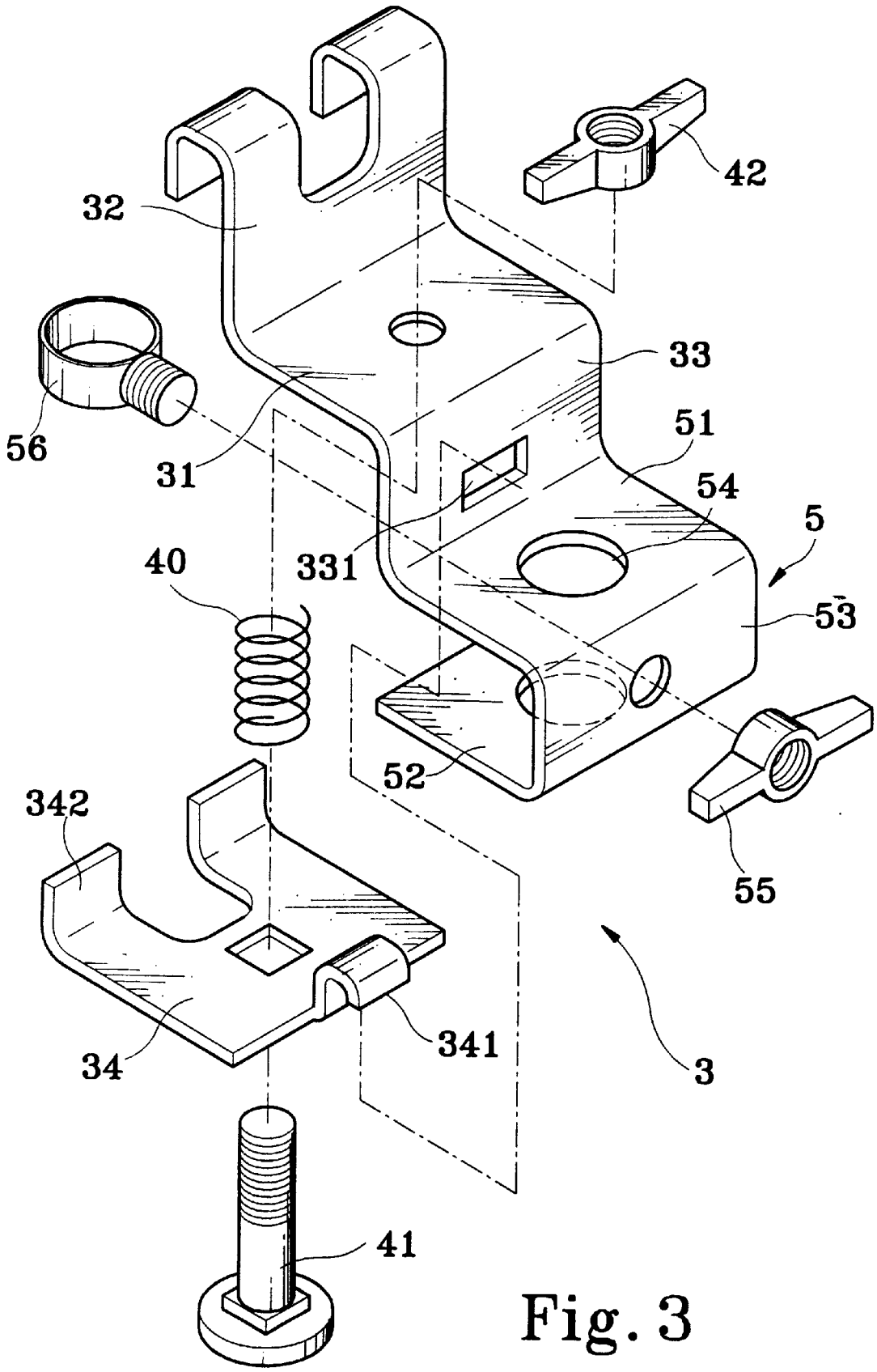
FIG. 3 is an exploded view of the invention.

Please refer to FIGS. 2 and 3, which are respectively a perspective view and an exploded view of the invention, as shown in the drawings: the invention involves the connection with a connecting mechanism 3 between a support leg stand 2 and a counterhoop (not shown in drawing) of a kettledrum (not shown in drawing), so there will be a proper distance between the kettledrum and the floor, said connecting mechanism 3 comprising:

a drum clamping mechanism 35 to join the kettledrum, said drum clamping mechanism has a main clamping unit 31, and extending in opposite directions from two sides of the main clamping unit 31 are a bent snap part 32 and a joining unit 33, on said joining unit 33 is a joining hole 331 for the purpose of joining an auxiliary clamping unit 34, wherein, extending from one side of said auxiliary clamping unit 34 is a joining part 341 corresponding to said joining hole 331, and extending from one side of said snap part 32 corresponding to said auxiliary clamping unit is a bent clamping part 342, for the purpose of forming a drum clamping area joined by said counterhoop with said snap part 32; and between said main and auxiliary clamping units 31, 34 is an adjusting unit, said adjusting unit involves a flexible component 40 located between the main and auxiliary clamping units 31, 34, a bolt 41 located inside the flexible component 40 and running through the main and auxiliary clamping units 31, 34, and an adjusting nut 42 joined to the bolt 41, for the purpose of adjusting the relative distance of the snap part 32 and the clamping part 342;

a connecting member 5 joined to a support leg 2, said connecting member 5 is joined with said drum clamping mechanism 35, wherein, said connecting member 5 involves mainly two plate bodies 51, 52, one side of said two plate bodies 51, 52 is connected with a shaft plate body 53, the other side of one plate body 51 is connected to said joining unit 33, on said two plate bodies 51, 52 is a set of connecting holes 54 to correspond the outside diameter of the support leg stands 2, and on the shaft plate body 53 is a fixing hole, for the installation of a fixing piece to fix the support leg stand, said fixing piece may be composed of an adjusting nut 55 and a collar 56, to connect the support leg stand 2.

By connecting the kettledrum and the support leg stand 2 with said connecting mechanism 3, the kettledrum will gain more secure support and the factor of vibration on the shell will be reduced.

Figure 4:
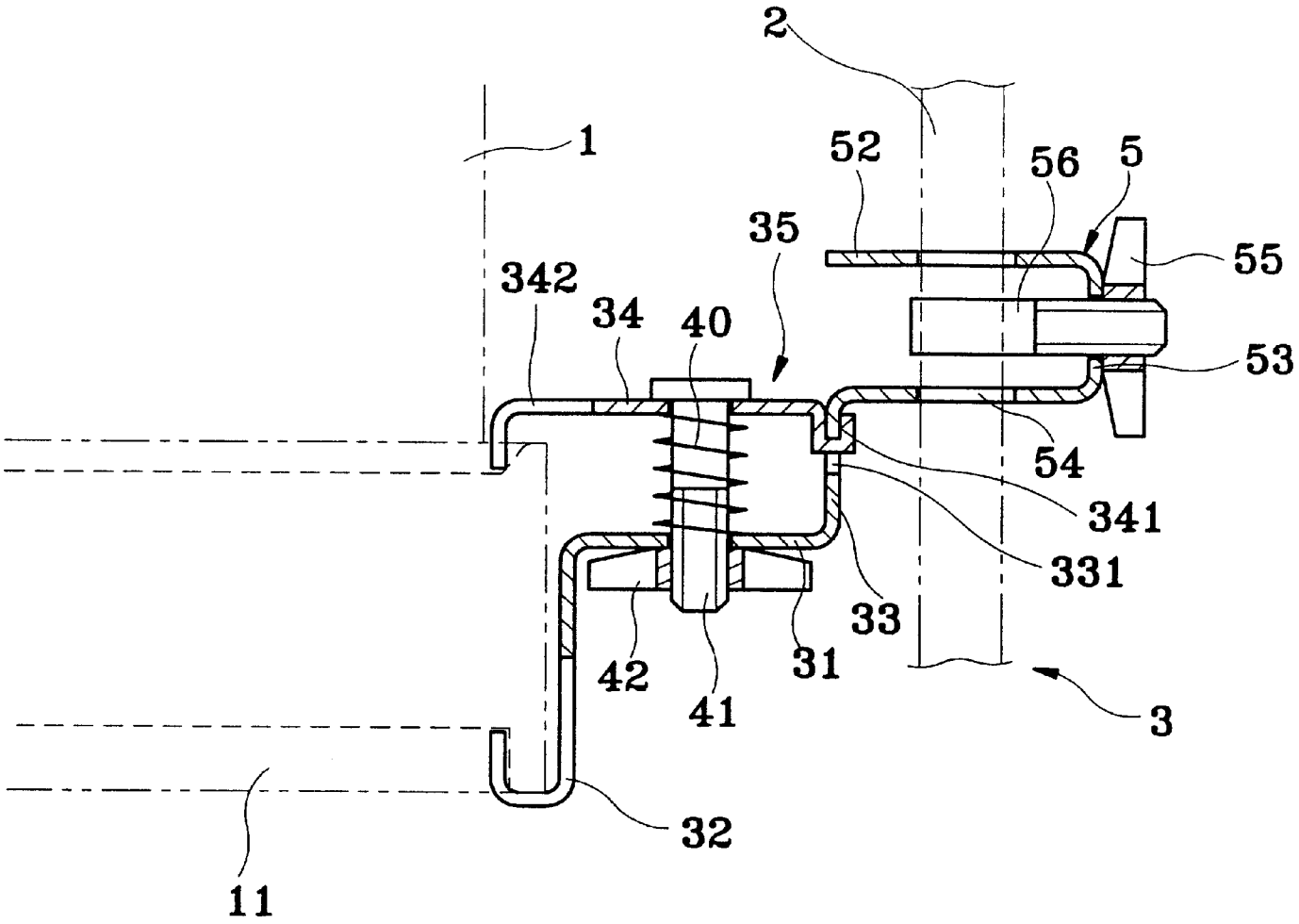
FIG. 4 is a side view of the invention.
Figure 5:
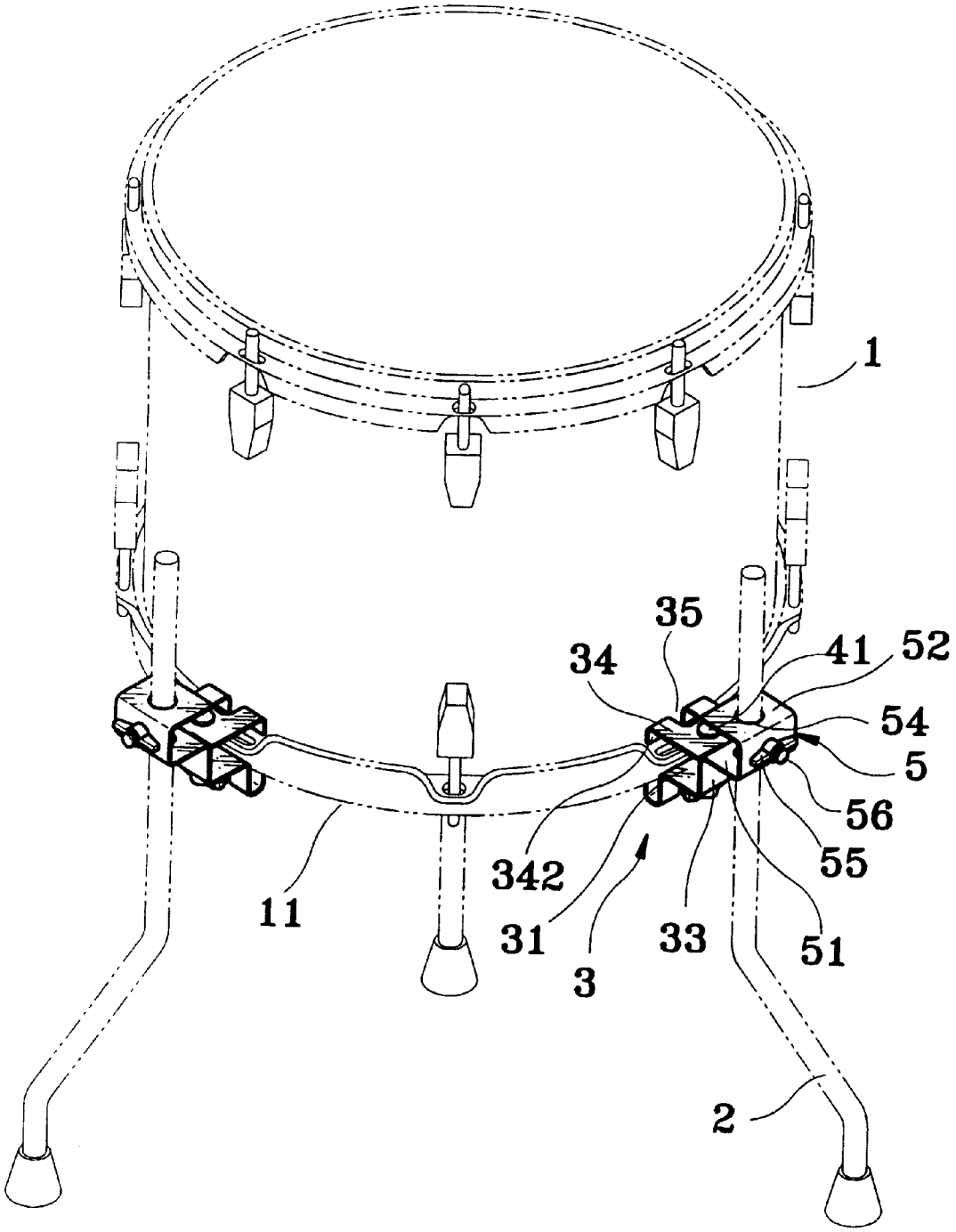
FIG. 5 is an embodiment view of the invention.

Please refer to FIGS. 4 and 5, which are a side sectional view and an embodiment view of the invention, as shown in the drawings: first, the snap part 32 of the main clamping unit 31 is fastened on the counterhoop 11, then, the adjusting nut 42 in the adjusting mechanism is screwed by the bolt 41 to tighten the flexible component 40, then, the joining part

341 of the auxiliary clamping unit 34 will force the auxiliary clamping unit 34 to move towards the main clamping unit 31, to shorten the relative distance between the snap part 32 and the clamping part 342, so the clamping part 342 will clamp on the counterhoop 11, and the connecting mechanism 3 will be divided in three 120° intervals, so the support of the kettledrum 1 will become more stable;

then, the support leg stand 2 is pulled through the two joining holes 54 of the two plate bodies 51, 52, the support leg stand 2 is surrounded by the collar 56, and the adjusting nut 55 is screwed to the collar 56, to fix the support leg stand 2, so there will be a proper distance between the kettledrum 1 and the floor; since the joining mechanisms 3 can be equally spaced at 120° intervals, the corresponding support leg stands can also be located at 120° intervals, and in case the drummer wishes to change the position of the drum, he may directly work on the adjusting mechanism in the connecting mechanism 3 to make necessary movement and adjustment on the counterhoop 11.

Figure 6:
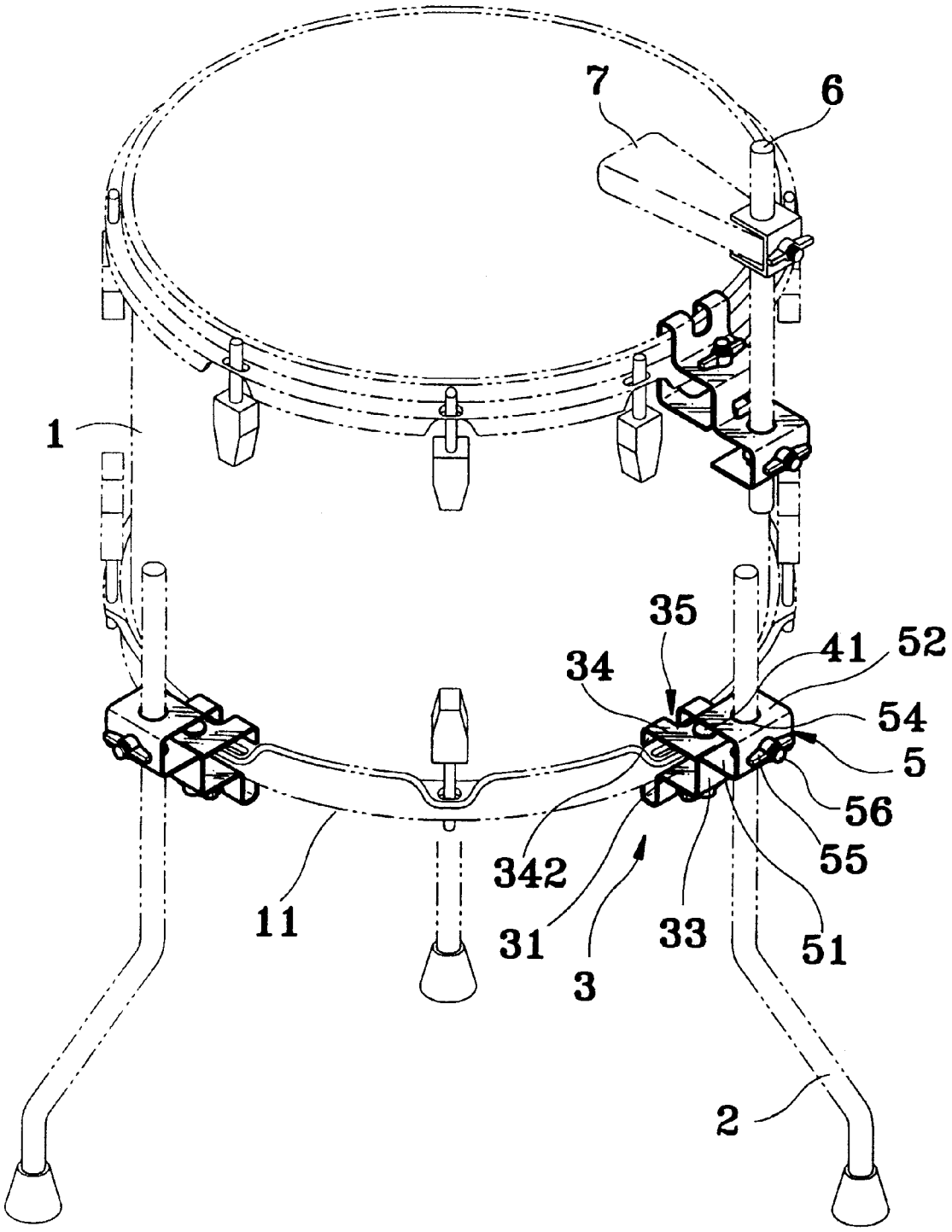
FIG. 6 is another embodiment view of the invention.

Please refer to FIG. 6, which is another embodiment view of the invention, as shown in the drawing: in addition to the supporting effect of said connecting mechanism 3 for the kettledrum 1, it may be connected with a connecting rod 6, on the connecting rod 6 may be connected another type of musical instrument 7 to accompany the drum (such as a tambourine, a symbol, a microphone, etc.), after said connecting rod 6 is pulled through the two connecting holes 54 of the connecting member 5, the connecting rod 6 will be inserted in the collar 56, the adjusting nut 55 is tightened to the collar 56, to fix the connecting rod 6, then the musical instrument 7 is joined to the connecting rod 6, to save the space for the display of musical instrument 7.

What I claim is:

1. A connecting mechanism for location between the support leg stand and the counterhoop of a kettledrum to maintain a proper distance between the kettledrum and the floor, said connecting mechanism comprising:

a drum clamping mechanism in connection with a kettledrum, said drum clamping mechanism includes a main clamping unit, extending from two sides of the main clamping unit in opposite directions are a bent snap part and a joining unit, an auxiliary clamping unit joined to the joining unit, said auxiliary clamping unit including a bent clamping part corresponding to a side of said snap part, whereby the snap part will form a drum clamping area for joining to said counterhoop, an adjusting mechanism between said main and auxiliary clamping units for adjusting the relative distance between the snap part and the bent clamping part;

a connecting member jointed to a support leg stand, said connecting member connected to said drum clamping mechanism, wherein, said connecting member includes two plate bodies, one side of each plate body being connected to a shaft plate body, another side of one plate body being connected to said joining body, said two plate bodies including a set of joining holes that correspond to the outside diameter of the support leg stand for receiving the stand therethrough, and the shaft plate body including a fixing piece for connecting to the support leg stand; and wherein by connecting said connecting mechanism to the kettledrum and the support leg stand, the support of the kettledrum can be more stable and the factor of vibration on the drum shell can be reduced.

2. The connecting mechanism as recited in claim 1, wherein said joining unit has a joining hole and the auxiliary clamping unit includes a joining part extending from one side thereof for engagement with the joining hole.

3. The connecting mechanism as recited in claim 1, wherein said adjusting mechanism includes a flexible component located between the main and auxiliary clamping units, a bolt located inside the flexible component and extending through the main and auxiliary clamping units, and an adjusting nut mounted on the bolt.

4. The connecting mechanism as recited in claim 1, wherein said fixing piece includes an adjusting nut and a collar.

* * * * *